United States Patent [19]

Alexander

[11] 3,930,678

[45] Jan. 6, 1976

[54] LOCKING MEANS FOR SLIDING CLOSURES

[76] Inventor: James H. Alexander, 6175 Delmar, St. Louis, Mo. 63112

[22] Filed: Oct. 21, 1974

[21] Appl. No.: 516,406

[52] U.S. Cl. ..... 292/288; 292/291; 292/297; 292/DIG. 20; 292/DIG. 46

[51] Int. Cl.[2] ..... E05C 19/18

[58] Field of Search ..... 292/42, 80, 87, 288, 289, 292/291, 297, 298, 300, 303, 316, DIG. 7, DIG. 20, DIG. 46, DIG. 47

[56] References Cited

UNITED STATES PATENTS

| | | | |
|---|---|---|---|
| 426,303 | 4/1890 | McGovern | 292/3 |
| 464,265 | 12/1891 | Montgomery | 292/251 |
| 572,591 | 12/1896 | Woodard | 292/3 |
| 1,137,321 | 4/1915 | Hogg | 292/3 |
| 1,571,024 | 1/1926 | Scheid | 292/156 |
| 2,003,128 | 5/1935 | Vazquez | 292/3 X |
| 3,526,421 | 9/1970 | Hirschler | 292/42 |

*Primary Examiner*—Robert L. Wolfe
*Attorney, Agent, or Firm*—Charles B. Haverstock

[57] ABSTRACT

Locking means to prevent movement between relatively movable members such as between sliding windows or sliding doors, said locking means including a body portion having a flange formed adjacent opposite edges, said flanges being substantially parallel to each other and each of said flanges having a projecting member adapted to be received in a hole provided in one of said relatively movable members when the locking means are positioned to prevent relative movement therebetween.

23 Claims, 12 Drawing Figures

LOCKING MEANS FOR SLIDING CLOSURES

In the past, many types of locking mechanisms have been provided for retaining two or more relatively movable closure members in a predetermined relation. A typical example of prior art locks in common use is the standard cam latch or crescent latch for sliding sash windows. While this type of lock is relatively simple and inexpensive to construct and install, it provides a lock which is relatively obtrusive and unattractive and which is relatively easy to open from the outside through use of a blade or other device introduced into the crack between the overlapping closure members. There have been prior art locks proposed which overcome some of these shortcomings but they have generally been quite expensive and mechanically complicated.

It is therefore a principal object of the present invention to provide novel locking means for locking sliding closures such as sliding windows and sliding doors which means are mechanically uncomplicated and comparatively simple and inexpensive to manufacture.

Another important object is to provide improved locking means which are attractive and unobtrusive and which can be readily applied to or detached from ordinary sliding closures when they are either open or closed.

Another object is to provide locking means which can be used to lock sliding closures in a partly open position by drilling additional receiving holes in the sliding closures.

Another object is to provide locking means which are not readily detachable from the outside and which are substantially burglar resistant.

Another object is to provide inexpensive and positive locking means for building contractors to install while a structure is under construction to secure it from theft or vandalism.

Another object is to provide security means permitting the painting of sliding closure members prior to the installation of conventional cam locking devices.

Another object is to provide locking means for sliding doors which prevent the removal of the outer door from its track.

Another object is to provide locking means which may be installed with minimum change to the existing structure.

Another object is to provide locking means which can be quickly and accurately installed even by persons having little mechanical skill.

Another object is to provide locking means which include drill bit locating points for easily and accurately locating holes for use in installing the locking means.

Another object is to provide locking means which may be mass produced with little equipment.

Another object is to provide locking means which may be used in pairs or other multiples for added security or protection.

These and other objects and advantages of the present invention will become apparent from considering the following detailed specification which covers several preferred embodiments thereof in conjunction with the accompanying drawing, wherein like numerals refer to like parts throughout, and in which.

DETAILED DESCRIPTION OF THE INVENTION

Figures 1, 2, 3, 4, 5, 6, 7, 8, 9, 10, 11, 12:
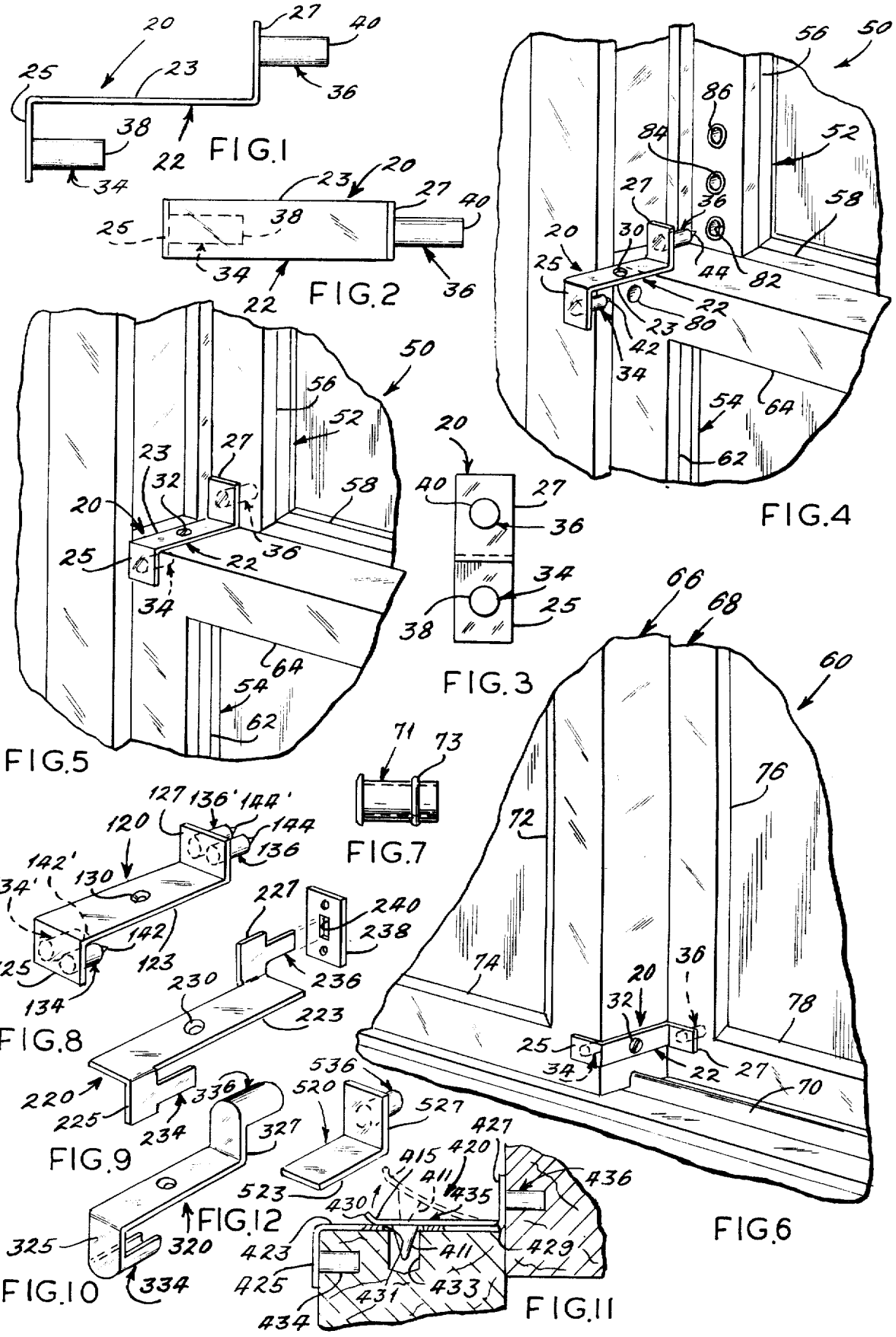
FIG. 1 is a side elevational view of a locking means for sliding closures constructed according to the teachings of the present invention.
FIG. 2 is a top plan view of the same locking means shown in FIG. 1.
FIG. 3 is a right end elevational view of the locking means shown in FIG. 1.
FIG. 4 is a perspective view showing the locking means before it is installed in locking position on a pair of sliding sash windows having protective sleeve members provided therein to receive the locking means.
FIG. 5 is a perspective view showing the locking means in locking position on the pair of sliding sash windows.
FIG. 6 is a perspective view showing the subject locking means in locking position on a pair of sliding doors.
FIG. 7 is a side elevational view of an optional protective sleeve member for use with the subject device.
FIG. 8 is a perspective view of a modified form of the locking means.
FIG. 9 is a perspective view of another modified form of the subject locking means.
FIG. 10 is a perspective view of still another modified form of the subject locking means.
FIG. 11 is a side elevational view in section showing another modified form of the subject locking means; and, FIG. 12 is a perspective view of another modified form of the subject locking means.

Referring to the drawing more particularly by reference numbers, number 20 identifies a locking device for sliding closures constructed according to the present invention. More particularly one form of the locking device 20 comprises a generally flat elongated body or strip member 22 having a Z-shaped cross-section as best seen in FIG. 1.

Now referring to FIGS. 1–6 specifically, the Z-shaped strip member 22 may be seen to comprise a flat body portion 23 having flanges 25 and 27 formed adjacent opposite ends thereof. The flanges 25 and 27 are formed substantially parallel to each other and are substantially perpendicular to the flat body portion 23.

Now referring to FIGS. 4 and 5 specifically, the flat body portion 23 may optionally be further provided with an aperture or hole 30 for cooperatively receiving a screw, nail or other fastening member 32 when it is desired that the locking device 20 be more permanently secured in locking position as best seen in FIG. 5. This prevents the device 20 from being jimmied or the like and is particularly important where the device is installed on sliding doors as in FIG. 6 or on a horizontally slidable window assembly as opposed to being installed on a more conventional double hung window assembly as shown in FIGS. 4 and 5.

Each of the flanges 25 and 27 as shown in FIGS. 1–6 is provided with an attached pin, peg or stop member 34 and 36, respectively; the stops 34 and 36 are preferably positioned in such a way that the free terminus of each 38 and 40, respectively, is on the same side and extends in the same direction. The stops 34 and 36 are further preferably positioned so that they are substantially parallel to the flat body portion 23 of the locking device 20. The stops 34 and 36 can be attached to the flanges 25 and 27 by forming holes in the flanges (not shown) which receive integral smaller diameter extensions of the stops which are then peened or otherwise crimped. The stops can also be attached using threaded fasteners (not shown) or they can be welded or the like to the flanges. In any case, it may be desirable to provide a jig to hold the several parts in position during assembly.

The stop members 34 and 36, as best seen in FIG. 4, have optional sharpened nubs or points 42 and 44, respectively, which are provided as means for locating the holes to be drilled in the sash members as more particularly described hereinafter. The stops 34 and 36 are preferably though not necessarily cylindrical in shape to match the holes drilled for them and to facilitate insertion therein as also described below.

In use, as shown in FIGS. 4–6, the locking means 20 may be used with any conventional sliding closure means such as a sliding double hung window closure 50 (FIGS. 4 and 5) or a sliding door (or window) closure 60 (FIG. 6). While the subject locking device 20 is shown for use with particular kinds of sliding closures, it will be appreciated that they are adapted for use with any two or more overlapping slidably mounted closure members and as such are useful for almost any sliding closure where two members are mounted for movement in closely spaced relationship, including constructions where only one member is movable as well as constructions where both members are movable as in the double hung window construction shown in FIGS. 4 and 5.

As shown in FIG. 4, the sliding window closure 50 comprises an upper vertically slidable sash 52 and a lower vertically slidable sash 54. The upper sliding sash 52 is provided with connected vertical portions 56 and horizontal portions 58. Similarly, the lower sliding sash 54 is provided with connected vertical stile portions 62 and horizontal stile portions 64. The sash members 52 and 54 are mounted for sliding movement in a jamb structure with spaced sash tracks which are separated by vertical members in the usual manner. In this type of window assembly each of the sash members 52 and 54 is vertically movable to open and close the window as desired.

The sliding door closure 60 shown in FIG. 6 comprises a first horizontally movable door member 66 and a second horizontally movable door member 68. The door members 66 and 68 can also comprise the sash members of a window assembly as well, and each of the members 66 and 68 is mounted for sliding movement in a track which in FIG. 6 is shown as including a guide fin or track forming member 70. Side wall or jamb members for the track may also be provided as desired. Frequently, but not always, one of the door members such as the second door 68 is stationary while the first door 66 is mounted on the track or guide fin 70 for slidable movement in relationship to the second door. The door member 66 as shown in FIG. 6 is provided with connected vertical and horizontal stile portions 72 and 74, respectively, while the second door is comparably provided with stile portions 76 and 78.

Referring again to FIG. 4, the locking device 20 is shown being installed in locking position on the sliding window closure 50. This is accomplished with the window in the desired position by bringing the lock into locking position on the horizontal stile portion 64 of the lower sash 54. When the lock 20 is to be installed for the first time, it is moved into the position shown and is advanced until the drill locating points 42 and 44 encounter the respective vertical stile portions 62 and 56. Sufficient pressure is then applied to the locking device 20 as by pressing or tapping so that the points 42 and 44 mark the frame and form pointed depressions or holes (not shown). These depressions are then used to locate drill bits used for drilling holes 80 and 82 which thereafter receive the respective stops 34 and 36.

Additional holes 84 and 86 may be provided in the upper vertical stile portion 56 if desired. These holes may be located for drilling purposes by the technique described above except with the upper sash 52 in different selected positions with respect to the lower sash 54. These additional holes enable the window assembly to be locked in different open positions with the locking device 20. In these positions the locking means 20 additionally serve to retain the window in the desired open condition.

When the locking device 20 is in locking engagement with the sliding sashes 52 and 54, as best seen in FIG. 5, the stop members 34 and 36 are cooperatively received in the apertures or holes 80 and 82, respectively. The locking device in this position provides a relatively jimmy-resistant lock. For additional security or protection, the threaded or other fastener 32 shown as a screw in FIG. 5 may be used. This is done to further resist unauthorized removal of the means 20 by a person using a knife, spatula or some other instrument or tool inserted or otherwise forced through the crack between the sliding sashes 52 and 54 to gain wrongful entry thereby. In most cases, no such fastener such as the screw 32 is required; it has been found, moreover, that usually only one locking device 20 per window assembly is necessary. However, more than one lock 20 may be used if desired. If two locks are used per window such as on the closure 50, they will usually be located on the opposite vertical stile portions 56. Similarly, usually only one locking device 20 is necessary to secure a sliding door such as the sliding door 60 shown in FIG. 6 although more may be used in this case as desired.

In FIG. 6, the sliding door closure 60 is shown secured by means of the single locking device 20 with the stop members or pins 34 and 36 cooperatively received in apertures (not shown) provided therefor in the vertical stile portions 72 and 76 of the door members 66 and 68, respectively. In this case, however, as in locking a horizontally sliding window construction the locking device 20 is oriented on its side as compared to its use as shown in FIGS. 4 and 5. This may make it easier to jimmy or otherwise remove the device from locking position and may make the need for an additional fastener such as the fastener 32 more important. In addition to providing means for securing the sliding type window and doors 60 in closed position, the locking device 20 may be used to secure the closures 60 in selected open positions when additional holes like the holes 84 and 86 in closure 50 are provided.

FIG. 7 is included to show an optional hole liner or sleeve device 71 which may be made of metal, plastic or some other suitable, preferably rust proof material. The liner 71 is made large enough so that it must be forced into a hole drilled therefor in a door or window assembly such as holes 80, 82, 84 and 86 in sashes 52 and 54. To this end, the liners 71 may optionally have variable diameter portions such as portion 73 which cooperate with corresponding slight enlargements or ribs on the pins or stops 34 and 36 (enlargements not shown on pins 34 and 36) so that the pins may be locked by snapping therein and resist easy removal of the locking device therefrom. This involves a question of proper manufacturing tolerances. Thus, it is contemplated in all of the constructions that the enlargements on the pins or their free ends 38 and 40 can be made so that they will snap into engaged positions in their respective mating holes. There are known means for achieving this, and such means by themselves are not part of the present invention.

Another embodiment 120 of the subject locking device is shown in FIG. 8. The locking device 120 has a flat elongated body portion 123 with an optional aperture 130 centrally located therein for cooperatively receiving a fastener (not shown) of the same type as the fastener 32 shown in FIGS. 5 and 6. Flanges 125 and 127 are formed adjacent opposite end edges of the body portion 123; attached to each of the flanges 125 and 127 is a pair of stop members or pins 134 and 134' (on the flange 125) and stop members or pins 136 and 136' (on the flange 127), respectively. The stops 134, 134', 136 and 136' are preferably positioned in such a way that they all face in the same direction. The stops 134, 134', 136 and 136' may have drilling locating points 142, 142', 144 and 144'. It is to be recognized, however, that providing drill locating points increases the cost of making the subject devices and that the points may be eliminated altogether or may be provided on selected ones such as only one or only a few sold in a package of devices to minimize the costs. Furthermore, with some practice a user can locate the drill holes simply by marking around the ends of the pins when they are positioned against the window or door elements. Although the pins 134, 134', 136 and 136' are shown as positioned on the flange in a plane parallel with the plane of the body portion 123, pins may be arranged in a plane perpendicular to the central portion 123 or at right angles to the pin arrangement shown in FIG. 8, in which case the hole arrangement in the window or door members must be similarly arranged.

Another form of the subject locking device 220 is shown in FIG. 9 and is formed from a single sheet or piece of material. This locking device 220 like the locking devices 20 and 120 has a flat elongated strip portion 223 having an optional hole 230 disposed centrally therein. Along opposite side edges of the strip portion 223 near the ends thereof are oppositely extending side flanges 225 and 227. These integral side flanges 225 and 227 each has an integral stop member 234 and 236, respectively, formed on corresponding ends thereof so that the entire construction can be made of a single piece of material such as a single piece of steel. Openings for receiving the stops are formed in the window or door assembly or alternatively larger openings can be formed in the assemblies and plates such as plates 238 with slotted openings 240 can be attached to accommodate the members 234 and 236 above.

The locking means 220 may be preferable in some cases over other forms including those described heretofore in that it may be less expensive to construct by means of simple, readily available stamping and forming devices, for example, although it may be more time consuming to install. This may be true if the installation is to be made on existing closure members but is not necessarily the case if the device is to be factory installed thereon.

Another form of the locking means 320 is shown in FIG. 10. The locking means 320, like the device of FIG. 9, is a one piece construction and is provided with end edge flanges 325 and 327. Formed on each of the flanges 325 and 327 is a rounded stop member 334 and 336, which stops are arranged in parallel relation and oppositely oriented. The locking device 320, like the locking device 220, may be formed from a single piece of material using well known and readily available forming and stamping techniques.

Other changes, modifications, variations and other uses and applications of the subject means are contemplated as within the scope of the present invention. For example, a modified form of the locking means is shown in FIG. 11 as locking device 420. This device includes a flat elongated body portion 423 having edge flanges 425 and 427 located on opposite ends. Attached to each flange is a stop member 434 and 436, respectively, said stop members being similar in design and function to the stop members 34 and 36 described above in connection with the locking device 20. The locking means 420 also includes a leaf spring locking portion 415 which is shown as associated with the body portion 423 to make it more difficult to remove the lock. The spring 415 is attached as by welding it to the locking means 420 at pivot 429 and the opposite end of the spring 415 may have an upturned portion 430 to facilitate lifting or pivoting the spring when installing or removing the device. The spring 415 is provided with a point or nub 411 which extends from one side thereof and is adapted to cooperate with an aperture 431 in the body 423 and with a hole or cavity 433 provided therefor in the sash member. The moved position of the spring 415 is indicated in broken lines in the drawing where it is shown that the nub 411 will clear the cavity 433 so that the locking device 420 may be installed and removed from the closure members in a manner similar to that in which the locking means 20 is installed or removed. In some cases, retention means 435 (the leaf spring 415 in combination with the nub 411) are superior to the fastener means 32 as shown in FIGS. 5 and 6 since the retention means 435 remain with the closure members at all times which is not the case with the fastener 32 which, as shown, is a screw requiring removal by means of a screw driver. On the other hand, the locking means 20 shown in FIGS. 4–6 enjoys advantages over the locking means 420 shown in FIG. 11 as to simplicity of mechanical construction and relative ease of manufacture.

Another embodiment 520 of the subject locking device is shown in FIG. 12. The locking device 520 has a flat elongated body portion 523. Flange 527 is formed adjacent one end edge of the body portion 523; attached to the flange 527 is a stop member 536. The stop 536 is preferably positioned centrally on the flange 527 and substantially parallel to the flat body portion 523 as shown. While this embodiment (the locking device 520) may be preferred in some cases for simplicity and economy of construction, it may in some cases be inferior to constructions like those discussed above. The simplified construction 520 can also be made with more than one stop 536 (like the construction shown in FIG. 8) or it can be formed as a one-piece construction (like the devices shown in FIGS. 9 and 10). It may be desired to provide an opening like hole 30 in the flat body portion 523 for more securely attaching the device to the appropriate portion of the window or door, thusly preventing rotation of the device in the holes provided for the stop 536 and further preventing its easy removal from locking position. In place of the hole 30, the device 520 could be provided with retention means similar to means 411 shown in FIG. 11 or the like.

Still other changes, modifications, variations and other uses and applications of the subject means will be apparent to those skilled in the art. All such changes, modifications, variations and other uses and applications which do not depart from the spirit and scope of the invention are deemed to be covered by the invention which is limited only by the subjoined claims.

What is claimed is:

1. Means for preventing relative movement between members mounted for relative sliding movement, each of said members having a surface with an opening formed therein, said means comprising a one-piece locking member having spaced substantially parallel means thereon for simultaneously cooperating with the openings formed in the relatively movable members whereby the members are locked in selected relative positions.

2. The means defined in claim 1 wherein the openings in the relatively movable members are cylindrical holes and the locking member has spaced connected positions with projections located thereon for simultaneously extending into the openings in the respective relatively movable members.

3. The means defined in claim 1 wherein the locking member is formed of one piece of folded material having projecting substantially parallel end portions simultaneously engageable with the respective openings in the relatively movable members.

4. The means defined in claim 1 including means for attaching the locking member to one of said relatively movable members to prevent disengagement between the means cooperatively engageable with the openings and the openings in the relatively movable members.

5. The means defined in claim 4 wherein the means for attaching the locking member to one of the relatively movable members includes a threaded member.

6. The means defined in claim 1 wherein the relatively movable members include sash members of a double hung sliding sash window assembly.

7. The means defined in claim 1 wherein the relatively movable members include a sliding door member of a sliding door assembly.

8. The means defined in claim 1 wherein the locking member includes an elongated member having a central portion with spaced and oppositely extending flanges formed adjacent opposite ends thereof, and wherein the means cooperatively engageable with the openings include a peg attached to each of said flanges on corresponding sides thereof, said pegs being substantially parallel to each other.

9. The means defined in claim 8 wherein two pegs are formed on each of said flanges and two openings are formed in each of said relatively movable members to cooperatively receive said pegs.

10. The means defined in claim 8 including means on at least one of said pegs to locate a place on one of said relatively movable members where one of the openings is to be made.

11. A bridge type lock for double hung window and sliding door assemblies comprising an assembly having at least one member that is slidably movable relative to another, each of said relatively movable members having a surface facing in the same direction with an opening formed therein, and a one-piece lock member having a Z-shaped cross-section and having a central portion with oppositely extending substantially parallel end flange portions, means extending in spaced parallel relation from corresponding sides of the respective end flange portions, said means being positioned to simultaneously cooperate with the openings in the respective relatively movable members in selected positions thereof.

12. Means for locking two relatively movable members to prevent relative movement therebetween comprising two relatively movable members, means mounting at least one of said relatively movable members for sliding movement relative to the other, each of said relatively movable members having a surface thereon, the surfaces being in spaced parallel relationship to each other, a hole in each of said members extending from said parallel surfaces, and a one-piece member having substantially parallel means thereon simultaneously engageable with the holes in the relatively movable members, said one-piece member having a portion that extends between the spaced parallel surfaces and connects the substantially parallel means thereon.

13. Means to prevent relative movement between members comprising a pair of members having adjacent surfaces at least one of which is movable relative to the other while maintaining the adjacent surfaces in parallel relationship, an opening in each of said movable members, said openings being substantially parallel to each other, and a one-piece bridge member having spaced connected portions, one of said portions having means for cooperating with the opening in one of said movable members and the other of said portions having means thereon for simultaneously cooperating with the opening in the other of said movable members, the simultaneous cooperation of the means on the bridge member with the respective openings preventing relative movement between the relatively movable members.

14. The means defined in claim 13 wherein the bridge member includes a central elongated portion with integral flanges formed extending in opposite directions from the ends of the central portion.

15. The means defined in claim 14 wherein the means on the bridge member for cooperating with the respective openings in the movable members include a projection on each of said flanges, said projections extending from corresponding sides of the flanges in spaced, substantially parallel relationship.

16. The means defined in claim 13 wherein the bridge member is formed of flat metal having an elongated central portion and oppositely extending right angle portions formed respectively on each opposite end.

17. The means defined in claim 13 wherein at least one of said openings and the means for cooperating therewith have portions which snap into engagement when the bridge member is installed.

18. The means defined in claim 13 including a plurality of spaced openings formed in one of said relatively movable members for cooperating with the means on the bridge member.

19. The means defined in claim 13 wherein at least one of said openings in the relatively movable members is provided with liner means.

20. The means defined in claim 13 wherein said means cooperating with the opening in at least one of the relatively movable members has an endwardly projecting pointed portion.

21. Means to prevent relative movement between two members each having adjacent parallel surfaces and side edges, one of which members is movable relative to the other in a direction substantially parallel to said parallel surfaces, an opening formed in one of the parallel surfaces of one of said members, the improvement comprising a one-piece locking member having a first portion cooperatively engageable with the opening in said one member and a second portion simultaneously engageable with the side edge of the other member.

22. Means for preventing relative movement between members mounted for relative sliding movement, each of said members having a surface with an opening formed therein, said means comprising a locking member having spaced means thereon for simultaneously cooperating with the openings formed in the relatively movable members whereby the members are locked in selected relative positions, and means for attaching the locking member to one of said relatively movable members, said means for attaching the locking member including spring biased means.

23. Means to prevent relative movement between members comprising a pair of members having adjacent surfaces at least one of which is movable relative to the other while maintaining the adjacent surfaces in parallel relationship, an opening in each of said movable members, said openings being substantially parallel to each other, means including a bridge member having spaced connected portions, one of said portions having means for cooperating with the opening in one of said movable members and the other of said portions having means thereon for simultaneously cooperating with the opening in the other of said movable members, the simultaneous cooperation of the means on the bridge member with the respective openings preventing relative movement between the movable members, a second opening formed in one of said relatively movable members adjacent to the bridge member, said second opening being angularly related to the aforesaid openings, and means including spring means movable into cooperative engagement with said second opening when the bridge member is installed.

* * * * *